United States Patent [19]

Reed

[11] 3,952,181

[45] Apr. 20, 1976

[54] HUMIDIFIER

[76] Inventor: Hugh T. Reed, 3067 Valwood Parkway, Farmers Branch, Tex. 75234

[22] Filed: Aug. 5, 1974

[21] Appl. No.: 494,990

[52] U.S. Cl. ..... 219/272; 126/113; 219/275; 261/130; 261/DIG. 15; 261/DIG. 46

[51] Int. Cl.[2] ..... F22B 1/28

[58] Field of Search ..... 219/271-273, 275-276, 362, 219/303, 304; 126/113; 122/40; 236/44 E; 128/180, 192; 261/129-130, 26, 142, DIG. 15, DIG. 46, DIG. 65

[56] References Cited

UNITED STATES PATENTS

| | | | |
|---|---|---|---|
| 219,311 | 9/1879 | Salisbury | 122/40 |
| 733,259 | 7/1903 | Neiman | 122/40 |
| 734,871 | 7/1903 | Hopwood | 122/40 |
| 1,515,954 | 11/1924 | Kline | 219/279 |
| 1,716,329 | 6/1929 | Simpson | 219/279 |
| 2,059,408 | 11/1936 | Stark | 126/113 X |
| 3,332,672 | 7/1967 | Schipper | 219/362 X |

*Primary Examiner*—C. L. Albritton
*Attorney, Agent, or Firm*—Richards, Harris & Medlock

[57] ABSTRACT

A humidifier includes an electric heating coil and a water receiving/steam generating coil both positioned in a steam generation zone of a housing. The heating coil functions to vaporize water flowing through the water receiving/steam generating coil into steam by raising the temperature within the steam generation zone to an operating temperature which is sufficiently high to kill bacteria entering the humidifier with the water. The water receiving/steam generating coil is formed from a material having substantial thermal expansion characteristics whereby the coil substantially expands as the temperature within the steam generation zone is raised and substantially contracts as the steam generation zone cools. The expansions and contractions of the coil dislodge sediment tending to form therein, and the sediment is flushed from the coil by the fluid flowing therethrough. Fluid from the water receiving coil together with any sediment carried thereby is discharged into the upper portion of a sediment separation zone in the housing. Steam passes directly from the upper portion of the sediment separation zone into the plenum chamber of an associated air handling apparatus. Sediment and any unvaporized water are received in the lower portion of the sediment separation zone under the action of gravity. A drain extending into the lower portion of the sediment separation zone functions as a syphon to periodically remove excess liquid accumulated therein. A switch mounted in the housing actuates the fan of the associated air handling apparatus whenever the humidifier is operating.

19 Claims, 2 Drawing Figures

HUMIDIFIER

BACKGROUND AND SUMMARY OF THE INVENTION

This invention relates to a humidifier, and more particularly to a self-contained humidifer which supplies steam that is free of bacteria, etc., and which automatically flushes sediment from the steam generating apparatus.

Over the years a wide variety of devices have been proposed for adding humidity to the air flowing through homes, offices, factories, and the like. One class of these devices may be characterized as non-heated. These devices operate by withdrawing water from a reservoir and directing the water into the moving air stream for evaporation thereby. One problem involved in the operation of devices of this type is that they tend to become clogged with sediment resulting from the evaporation process, and therefore must be cleaned regularly in order to assure efficient operation. Another problem involves the fact that such devices tend to pass bacteria and other potentially harmful microorganisms which may be received with the water directly into the air stream. The latter is particlarly undesirable in the case of hospitals, nursing homes, and similar applications.

Another type of prior art humidifier comprises heated devices. Often devices of this type utilize the heated products of combustion flowing from a furnace as a heat source. This heat is utilized to vaporize water flowing through a coil into steam, and the steam is in turn injected into the moving air stream. A significant problem that is encountered with the operation of devices of this type involves the fact that the furnace must be operating in order to provide a heat source. These devices are also similar to non-heated humidifiers in that they tend to become clogged with sediment, and in that they tend to pass bacteria or other microorganisms received in the water into the moving air stream.

The present invention comprises a novel humidifier which overcomes the foregoing and other problems long since associated with the prior art. In accordance with the broader aspects of the invention, an electric heating coil and a water receiving/steam generating coil are mounted in a steam generation zone within a housing. The electric heating coil functions to vaporize water passing through the water receiving/steam generating coil into steam by raising the temperature within the steam generation zone from the ambient temperature to an operating temperature which is sufficiently high to kill bacteria and other microorganisms entering the humidifier with the water. The water receiving/steam generating coil is formed from material which substantially expands as the temperature within the steam generation zone is raised to the operating temperature, and which subsequently substantially contracts as the steam generation zone cools following de-actuation of the electric heating coil. The expansion and contraction of the water receiving/steam generating coil dislodge sediment tending to accumulate therein, and the dislodged sediment is flushed from the coil with the fluid flowing therethrough.

Fluid flowing from the water receiving/steam generating coil together with any sediment carried thereby is discharged into the upper portion of a sediment separation zone in the housing. Steam is in turn directed from the upper portion of the sediment separation zone into the plenum chamber of an associated air handling apparatus. Sediment together with any unvaporized water flowing from the water receiving/steam generating coil are received in the lower portion of the sediment separation zone under the action of gravity. A drain apparatus extending into the lower portion of the sediment separation zone functions as a syphon to periodically withdraw excess liquids accumulated therein.

The humidifier operates under the regulation of an electrical control circuit. The circuit includes a temperature responsive switch which operates the electric heating coil through cycles of actuation and de-actuation each having a predetermined time duration to maintain the operating temperature within the steam generation zone. Water is admitted to the water receiving/steam generating coil through a solenoid-operated valve which is controlled by a slow-to-release relay.

The release time of the slow-to-release relay is longer than the operating cycles of the electric heating coil, so that water continuously flows through the water receiving/steam generating coil during the operation of the humidifier. Water also flows through the coil for a predetermined time following the termination of operation of the electric heating coil to cool the water receiving/steam generating coil and to flush sediment therefrom. The electric control circuit further includes a temperature responsive switch mounted in the steam generation zone which functions to actuate the fan of the associated air handling apparatus whenever the humidifier is operating to supply humidity.

DESCRIPTION OF THE DRAWINGS

A more complete understanding of the invention may be had by reference to the following Detailed Description when taken in conjunction with the accompanying Drawings, wherein.

DETAILED DESCRIPTION

Figure 1:
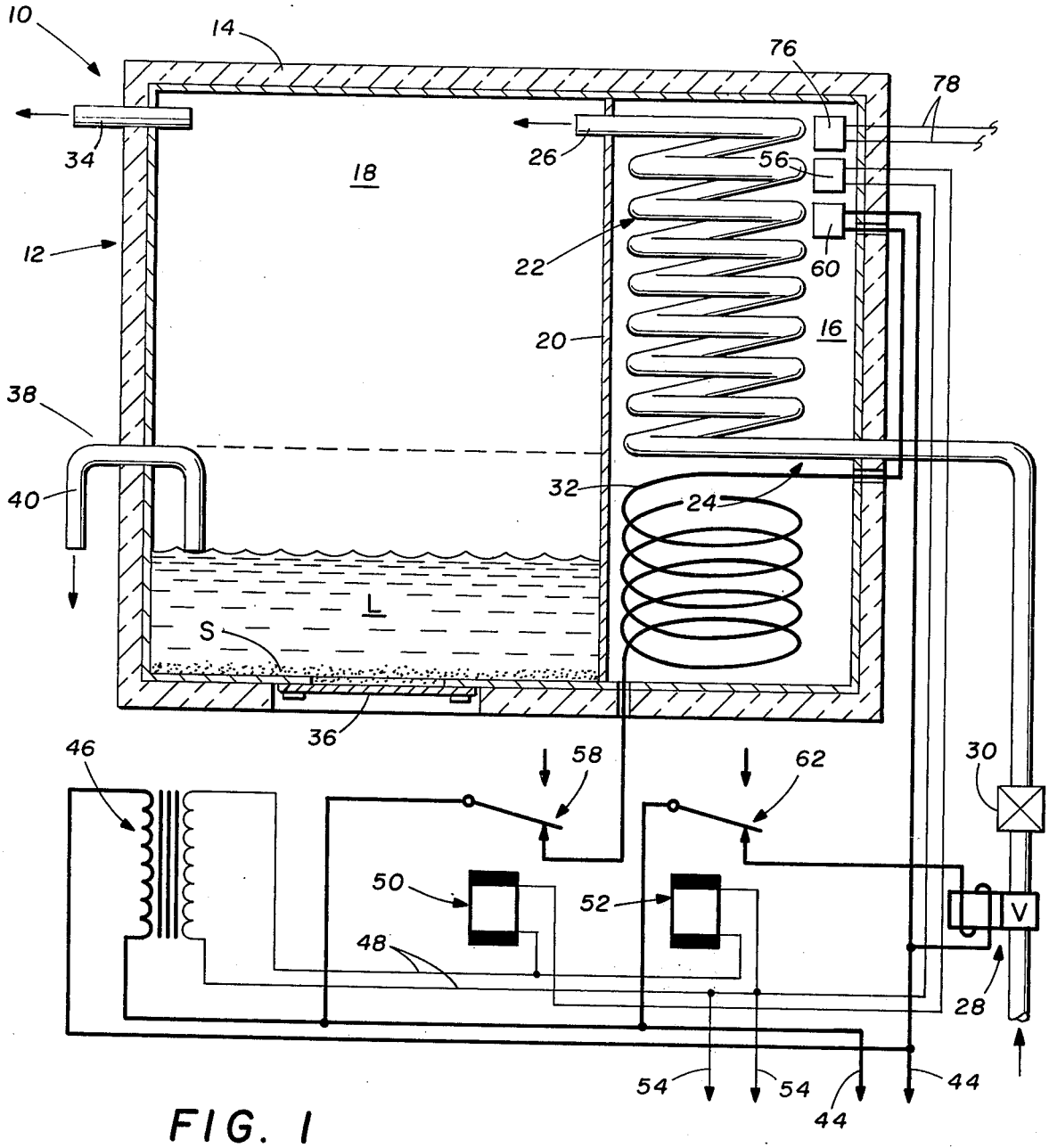
FIG. 1 is an illustration of a humidifier incorporating the invention.

Referring now to the Drawings, and particularly to FIG. 1 thereof, there is shown a humidifier 10 incorporating the invention. The humidifierr 10 includes a housing 12 which may be formed from a corrosion resistant sheet metal material, such as galvanized steel, stainless steel, aluminum, brass, or the like. Alternatively, the housing 12 may be formed from one of the various plastic materials which is stable at temperatures up to approximately 500° F. The housing 12 may be provided with an outer covering 14 formed from a thermal insulating material, if desired.

The housing 12 of the humidifier 10 defines a steam generation zone 16 and a sediment separation zone 18. In the illustrated embodiment of the invention, the zones 16 and 18 are separated by a baffle 20. However, the use of the baffle 20 is not necessary in the practice of the invention in that the steam generation zone 16 and the sediment separation zone 18 may comprise spaced apart portions of the housings 12 which are not separated by a baffle, if desired.

A water receiving/steam generating coil 22 is mounted in the steam generation zone 16 of the housing 12. The coil 22 extends from an inlet end 24 through the steam generation zone 16 to an inlet end 26 positioned in the upper portion of the sediment separation zone 18 of the housing 12. Water is received in the coil 22 through a solenoid-controlled valve 28 and an orifice 30. The valve 28 is operated to selectively permit or prevent water flow into the coil 22, while the orifice 30 functions to regulate the rate of water flow through the coil 22. As the water flows through the coil 22 in the steam generation zone 16 it is vaporized into steam, and the resulting steam is discharged into the sediment separation zone 18 through the outlet 26.

The coil 22 is formed from a material having a substantial rate of thermal expansion in the temperature range extending between ambient temperature (approximately 75°F.) and a predetermined operating temperature for the humidifier 10 (for example, approximately 400°F.) For example, the coil 22 may be formed from aluminum. Because of its coefficient of thermal expansion, the coil 22 substantially expands as the temperature in the steam generation zone 16 is raised from the ambient temperature to the operating temperature, and substantially contracts as the temperature within the steam generation zone 16 is subsequently reduced from the operating temperature to the ambient temperature. Such expansions and contractions of the coil 22 function to dislodge any sediment that may have accumulated therein. The sediment in turn is carried through the coil 22 and is discharged from the outlet 26 with the fluid flowing through the coil.

An electric heating coil 32 is also mounted in the steam generation zone 16. The coil 32 functions to selectively raise the temperature within the steam generation zone 16 from the ambient temperature to a predetermined operating temperature, for example, approximately 400°F. The use of a relatively high operating temperature is preferred in the operation of the humidifier 10 in order to kill any bacteria or other microorganisms which may be carried into the system 10 with the water entering the coil 22. By this means the humidifier 10 functions to deliver steam which is substantially free of any such potentially harmful microorganisms, thereby eliminating a problem often associated with prior art humidifiers.

In the operation of the humidifier 10, fluid flowing through the coil 22 is discharged into the upper portion of the sediment separation zone 18 of the housing 12. This fluid is normally substantially entirely comprised of steam, but may also include a small amount of unvaporized water. Also, any sediment dislodged from the interior of the coil 22 due to the expansions and contractions thereof or otherwise is carried through the coil 22 by the fluid flowing therein. All of these materials are discharged into the upper portion of the sediment separation zone 18 through the outlet 26 of the coil 22.

Steam flowing into the upper portion of the sediment separation zone 18 is immediately discharged therefrom through an outlet 34. Unvaporized water entering the sediment separation zone 18 together with any water resulting from the condensation within the sediment separation zone 18 accumulates in the lower portion thereof under the action of gravity to define a quantity of liquid L. Sediment received in the sediment separation zone 18 through the outlet 26 accumulates in the lower portion thereof under the action of gravity to form a sediment layer S. The sediment layer may be cleaned from the housing by means of a door 36.

The housing 12 is provided with a drain apparatus 30 mounted in the lower portion of the sediment separation zone 18. The drain apparatus 38 comprises a tube 40 having an inverted U-shaped configuration. By means of this configuration, the drain apparatus 38 functions as a syphon. That is, whenever the level of the quantity of liquid L accumulating in the lower portion of the sediment separation zone 18 rises to the plane approximately indicated by the dashed line in FIG. 1, the drain apparatus 38 automatically functions to syphon the liquid out of the lower portion of the sediment separation zone 18. This syphoning action continues until the level of the quantity of liquid L in the lower portion of the sediment separation zone 18 is reduced to the plane approximately indicated by the solid line in FIG. 1.

FIG. 1 further illustrates an electrical control circuit 42 which is utilized in the humidifier 10 to selectively actuate the electric heating coil 32 and thereby regulate the temperature within the steam generation zone 16 and to selectively actuate the solenoid-controlled valve 28 and thereby regulate the flow of water into the coil 22. The circuit 42 receives conventional 110 volt, 60 hz line current through a pair of leads 44. The leads 44 are connected to one side of a transformer 46, the opposite side of which functions to supply low voltage control current to a pair of leads 48. One of the leads 48 extends to one terminal of the coil of a heater control relay 50 and to one terminal of the coil of a valve control relay 52. The relay 52 is a slow-to-release relay. The other lead 48 is connected to one of a pair of leads 54.

The leads 54 extend to a humistat (not shown). Whenever the humistat determines that additional humidity is required, a signal is applied to the leads 54 in the form of an electrical connection therebetween. This causes actuation of the relay 50 through a temperature controlled switch 56 and direct actuation of the relay 52.

Upon actuation, the relay 50 closes a normally open contact pair 58, thereby supplying operating power to the electric heating coil 32. The coil is connected in series with a temperature responsive high limit switch 60 which functions to terminate operation of the coil 32 in the event that the temperature within the steam generation zone 16 exceeds a predetermined maximum upper limit, for example, 500°F. Upon actuation, the relay 52 closes a normally open contact pair 62, thereby supplying operating power to the coil of the solenoidoperated valve 28. This opens the valve 28 to permit water flow into the coil 22. The rate of water flow into the coil 22 is regulated by the orifice 30.

It will be understood that the actuation of the electric heating coil 32 by means of the relay 50 and the opening of the valve 28 by means of the relay 52 occur substantially simultaneously. This means that the temperature within the steam generation zone 16 is initially not sufficiently elevated to cause the vaporization of the water flowing through the coil 22 into steam. This is advantageous in that the water flowing through the coil 22 during the initial phase of the operation of the humidifier 10 tends to clear sediment out of the coil 22 which may have been dislodged during the previous contraction thereof. Also, as the temperature within the steam generation zone 16 rises, additional sediment may be dislodged, and this sediment is also carried out of the coil 22 by the water flowing therethrough.

As the electric heating coil 32 brings the temperature within the steam generation zone 16 up to the predetermined operating temperature, for example, approximately 400°F., the water flowing through the coil 22 is vaporized and is discharged from the outlet 26 in the form of steam. The relatively high operating temperature of the humidifier 10 functions to kill any bacteria or other micoorganisms which might enter the coil 22 with the water flowing therethrough. Therefore, the steam discharged from the outlet 26 is substantially free of such microorganisms. This steam is in turn discharged from the housing 12 through the outlet 34.

Those skilled in the art will appreciate the fact that after the electric heating coil 32 has functioned to bring the temperature in the steam generation zone 16 up to the predetermined operating temperature, the temperature responsive switch 56 functions to operate the coil 32 through cycles of operation each having a predetermined time duration. In this manner the coil 32 functions to maintain the temperature within the steam generation zone 16 at the operating temperature on a substantially constant basis. The relay 52 is a slow-to-release relay, and has a release period which is longer in time duration than the operating cycle of the electric heating coil 32 under the control of the temperature responsive switch 56. Therefore, the valve 28 is maintained in an opened condition throughout each operating cycle of the electric heating coil 32, and water continuously flows into the coil 22 during the operation of the humidifier 10.

When the humistat determines that further humidity is not required, the predetermined input signal is removed from the leads 54. In effect, this causes an electrical disconnection between the leads 54. The relay 50 is immediately de-energized, thereby discontinuing operation of the electric heating coil 32. However, since the relay 52 is a slow-to-release relay, the valve 28 is maintained in an open condition for a predetermined period of time following the termination of operation of the electric heating coil 32.

Since the valve 28 is maintained in an open condition, water continues to flow into the coil 22 after the operation of the coil 32 has been terminated. This is beneficial in reducing the temperature of the coil 22 and also in flushing any dislodged sediment therefrom. Also, as the temperature within the steam generation zone 16 drifts downwardly from the predetermined operating temperature to the ambient temperature, the coil 22 contracts which may cause additional sediment to be dislodged from the interior thereof. Any such additional sediment is also flushed from the interior of the coil 22 under the action of the water flowing therethrough.

Figure 2:
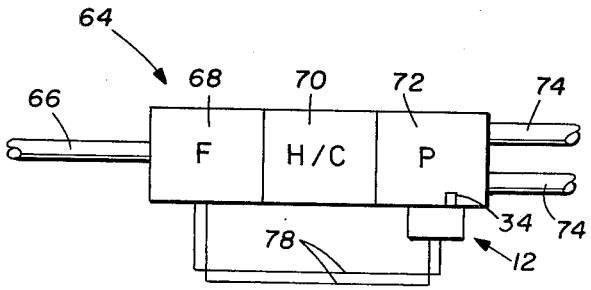
FIG. 2 is an illustration of an air handling system utilizing the humidifier of FIG. 1.

Referring now to FIG. 2, the humidifier 10 is utilized in conjunction with an air handling system 64. The air handling system receives air through a return conduit 66. The air passes through a fan 68, an air heating and/or air cooling apparatus 70, and a plenum chamber 72. From the plenum chamber 72, the air is directed to outlet conduits 74 for distribution to selected points in the interior of a home, an office, a hospital, or the like.

The housing 12 of the humidifier 10 is secured to the exterior wall of the plenum chamber 72. The steam outlet 34 extends directly into the plenum chamber 72. Thus, steam generated in the humidifier 10 is admitted directly into the air flowing through the plenum chamber 72 for immediate distribution through the outlet conduits 74.

Referring simultaneously to FIGS 1 and 2, a temperature responsive switch 76 is provided in the steam generation zone 16 of the housing 12 of the humidifier 10. The switch 76 is connected through leads 78 to the fan 68 of the air handling apparatus 64. Thus, whenever the temperature within the steam generation zone 16 reaches the predetermined operating temperature under the action of the electric heating coil 32, the switch 76 operates through the leads 78 to initiate operation of the fan 68. The air handling system 64 therefore functions to distribute humidified air through the outlet conduit 74 even though the air heating and/or air cooling apparatus 70 of the air handling system 64 may not be functioning at that particular time.

From the foregoing, it will be understood that the present invention comprises a humidifier incorporating numerous advantages over the prior art. One of the most important advantages deriving from the use of the invention involves the fact that humidifiers constructed in accordance therewith comprise entirely self-contained units, and do not depend on an external source of heat to provide a source of humidity. Another important advantage deriving from the use of the invention involves the fact that humidifiers constructed in accordance therewith are adapted to provide humidity which is relatively free of any bacteria or other potentially harmful microorganisms. Still another advantage deriving from the use of the invention involves the fact that humidifiers constructed in accordance therewith function substantially automatically to flush sediment from the interior of the steam generating apparatus.

Although preferred embodiments of the invention have been illustrated in the accompanying Drawings and described in the foregoing Detailed Description, it will be understood that the invention is not limited to the embodiments disclosed, but is capable of numerous rearrangements, modifications, and substitutions of parts and elements without departing from the spirit of invention.

What is claimed is:

1. A humidifier comprising:

a housing including a steam generation zone and a sediment separation zone having an upper portion and a lower portion;

heating means for selectively raising the temperature within the steam generation zone in the housing from ambient temperature to a predetermined operating temperature;

coil means for directing water through the steam generation zone of the housing so that when the temperature therein is at the predetermined operating temperature the water is vaporized into steam;

the coil means being formed from a material having a substantial coefficient of thermal expansion between ambient temperature and the predetermined operating temperature so that the coil means substantially expands as the temperature in the steam generation zone is raised under the action of the heating means and substantially contracts as the temperature within the steam generation zone is reduced upon de-energization of the heating means;

the expansions and contractions of the coil means causing separation of sediment from the interior thereof which sediment is carried through the coil means by the fluid flowing therethrough;

means for discharging the fluid flowing through the coil means into the upper portion of the sediment separation zone of the housing so that sediment and unvaporized water flowing from the coil means are separated from steam by the action of gravity and deposited in the lower portion of the sediment separation zone; and means for discharging steam from the upper portion of the sediment separation zone of the housing.

2. The humidifier according to claim 1 wherein the heating means comprises electric heating means mounted in the steam generation zone of the housing.

3. The humidifier according to claim 2 further including control means responsive to a predetermined input signal for actuating the electric heating means to raise the temperature in the steam generation zone of the housing from ambient temperature to the predetermined operating temperature and for simultaneously causing water flow into the coil means in the steam generation zone of the housing.

4. The humidifier accoridng to claim 3 wherein the control means is further characterized by:

temperature responsive means for actuating the electric heating means through cycles of actuation and de-actuation each having a predetermined time duration to maintain the temperature within the steam generation zone substantially at the predetermined operating temperature;

valve means for controlling the flow of water into the coil means within the steam generation zone; and means for operating the valve means to cause continuous water flow into the coil means during each operating cycle of the electric heating means and for continuing the flow of water into the coil means for a predetermined time after the last operating cycle of the electric heating means to cool the coil means and to flush sediment therefrom.

5. The humidifier according to claim 4 further including means for regulating the rate of water flow into the coil means when the valve means is open.

6. The humidifier according to claim 1 further including drain means mounted in the lower portion of the sediment separation zone of the housing and comprising syphon means responsive to the accumulation of a predetermined quantity of liquid in the lower portion of the sediment separation zone for automatically reducing the quantity of liquid therein to a predetermined lower level.

7. A humidifier comprising:

a housing including a steam generation zone and a sediment separation zone having upper and lower portions;

electric heating means for selectively raising the temperature within the steam generation zone in the housing from ambient temperature to a predetermined operating temperature;

coil means for receiving water and for directing the water through the steam generation zone of the housing so that the water is vaporized into steam when the temperature within the steam generation zone is at the predetermined operating temperature, said coil means being formed from a material having a substantial coefficient of thermal expansion between ambient temperature and predetermined operating temperature so that the coil means substantially expands as the temperature in the steam generation zone of the housing is raised under the action of the electric heating means and substantially contracts as the temperature within the steam generation zone is subsequently reduced, the expansions and contractions of the coil means causing separation of sediment from the interior thereof which sediment is carried through the coil means by fluid flowing therethrough;

means for discharging fluid flowing from the coil means into the upper portion of the sediment separation zone of the housing so that sediment and unvaporized water flowing from the coil means are separated from steam by the action of gravity and deposited in the lower portion of the sediment zone; and means for discharging steam from the upper portion of the sediment separation zone of the housing.

8. A humidifier comprising:

a housing including a steam generation zone and a sediment separation zone having upper and lower portions;

electric heating means for selectively raising the temperature within the steam generation zone in the housing from ambient temperature to a predetermined operating temperature;

coil means for receiving water and for directing the water through the steam generation zone of the housing so that the water is vaporized into steam when the temperature within the steam generation zone is at the predetermined operating temperature;

means for discharging fluid flowing from the coil means into the upper portion of the sediment separation zone of the housing so that sediment and unvaporized water flowing from the coil means are received in the lower portion of the sediment separation zone under the action of gravity;

means for discharging steam from the upper portion of the sediment separation zone of the housing;

electrical control circuit means responsive to a predetermined input signal for actuating the electric heating means to raise the temperature within the steam generation zone of the housing from ambient temperature to the predetermined operating temperature;

valve means for controlling the flow of water into the coil means within the steam generation zone of the housing; and means responsive to the same input signal which actuates the electric heating means to actuate the valve means to permit water flow to the coil means.

9. The humidifier according to claim 8 further characterized by means for regulating the rate of flow of water into the coil means.

10. The humidifier according to claim 9 further characterized by:

temperature responsive means for actuating the electric heating means through cycles of actuation and de-actuation each having a predetermined time duration to maintain the temperature within the steam generation zone of the housing substantially at the predetermined temperature; and

11. The humidifier according to claim 8 further including means for draining accumulated liquid from the lower portion of the liquid separation zone of the housing and comprising syphon means responsive to the accumulation of a predetermined quantity of liquid in the lower portion of the sediment separation zone for automatically reducing the quantity of liquid therein to a predetermined lower level.

means for operating the valve means to cause continuous water flow into the coil means during each operating cycle of the electric heating means and for continuing the flow of water into the coil means for a predetermined time after the last operating cycle of the electric heating means to cool the coil means and to flush sediment therefrom.

12. In combination with an air handling system of the type including a fan for directing air through apparatus including a plenum chamber, a humidifier comprising:

a housing including a steam generation zone and a sediment separation zone having an upper portion and a lower portion;

electric heating means for selectively raising the temperature within the steam generation zone in the housing from ambient temperature to a predetermined operating temperature;

coil means for receiving water and for directing the water through the steam generation zone of the housing so that the water is vaporized into steam when the temperature within the steam generation zone is at the predetermined operating temperature;

means for discharging fluid flowing from the coil means into the upper portion of the sediment separation zone of the housing so that sediment and unvaporized water flowing from the coil are received in the lower portion of the sediment separation zone under the action of gravity;

means for discharging steam from the upper portion of the sediment separation zone into the plenum chamber of the air handling system; and means responsive to the temperature within the steam generation zone of the housing for effecting actuation of the fan of the air handling system.

13. The humidifier according to claim 12 further including electrical control circuit means responsive to a predetermined input signal for actuating the electric heating means to raise the temperature in the steam generation zone in the housing from ambient temperature to the predetermined operating temperature.

14. The humidifier according to claim 13 wherein the electrical control circuit means further functions responsive to the predetermined input signal to cause the flow of water into the coil means.

15. The humidifier according to claim 14 wherein the control means is further characterized by:

temperature responsive means for actuating the electric heating means through cycles of actuation and de-actuation each having a predetermined time duration to maintain the temperature within the steam generation zone substantially at the predetermined operating temperature;

valve means for controlling the flow of water into the coil means; and means for operating the valve means to cause continuous water flow into the coil means during each operating cycle of the electric heating means and for continuing the flow of water into the coil means for a predetermined time after the last operating cycle of the electric heating means to cool the coil means and to flush sediment therefrom.

16. The humidifier according to claim 15 further including means for regulating the rate of water flow into the coil means.

17. The humidifier according to claim 15 wherein the valve means comprises a solenoid-operated valve and wherein the valve operating means comprises a slow-to-release relay.

18. The humidifier according to claim 12 wherein the coil means is formed from a material having a substantial coefficient of thermal expansion between ambient temperature and the predetermined operating temperature so that the coil means substantially expands as the temperature in the steam generation zone is raised under the action of the electric heating means and substantially contracts as the temperature in the steam generation zone is subsequently reduced to the ambient temperature, the expansions and contractions of the coil means causing separation of sediment from the interior thereof, which sediment is carried through the coil means by fluid flow therethrough and is discharged into the sediment separation zone of the housing.

19. The humidifier according to claim 12 further including drain means for removing liquid accumulating in the lower portion of the sediment separation zone of the housing and comprising syphon means responsive to the accumulation of a predetermined quantity of liquid in the lower portion of the sediment separation zone for automatically reducing the quantity of liquid therein to a predetermined lower level.

* * * * *

UNITED STATES PATENT OFFICE

CERTIFICATE OF CORRECTION

Patent No. 3,952,181 Dated April 20, 1976

Inventor(s) Hugh T. Reed

It is certified that error appears in the above-identified patent and that said Letters Patent are hereby corrected as shown below:

Col. 2, line 45, "humidifierr" should be --humidifier--.

Col. 4, line 48, "solenoidoperated" should be --solenoid-operated-

Col. 5, line 5, "micoorganisms" should be --microorganisms--.

Col. 7, line 17, "accoridng" should be --according;
line 60, before "predetermined" insert --the--.

Col. 8, line 56, insert the following paragraph after the word "and"
--means for operating the valve means to cause continuous water flow into the coil means during each operating cycle of the electric heating means and for continuing the flow of water into the coil means for a predetermined time after the last operating cycle of the electric heating means to cool the coil means and to flush sediment therefrom--.

Col. 8, lines 65-68, delete everything.

Col. 9, lines 1-3, delete everything.

Signed and Sealed this

Tenth Day of August 1976

[SEAL]

*Attest:*

RUTH C. MASON
*Attesting Officer*

C. MARSHALL DANN
*Commissioner of Patents and Trademarks*